US005177407A

United States Patent [19]

Godyak

[11] Patent Number: 5,177,407

[45] Date of Patent: Jan. 5, 1993

[54] GLOW DISCHARGE LAMP HAVING DUAL ANODES AND CIRCUIT FOR OPERATING SAME

[75] Inventor: Valery Godyak, North Andover, Mass.

[73] Assignee: GTE Products Corporation, Danvers, Mass.

[21] Appl. No.: 289,951

[22] Filed: Dec. 27, 1988

[51] Int. Cl.[5] ..... H05B 41/16; H01J 61/06

[52] U.S. Cl. ..... 315/260; 313/581; 313/621; 313/632; 313/491; 315/266; 315/337

[58] Field of Search ..... 315/260, 266, 337; 313/581, 621, 632, 491

[56] References Cited

U.S. PATENT DOCUMENTS

| | | | |
|---|---|---|---|
| 2,259,954 | 10/1941 | Gustin | 315/266 X |
| 2,356,369 | 8/1944 | Abernathy | 315/100 |
| 2,401,998 | 6/1946 | Williams | 313/310 |
| 3,500,122 | 3/1970 | Sohl | 315/266 X |
| 3,635,537 | 1/1972 | Miller et al. | 315/260 X |
| 3,787,751 | 1/1974 | Farrow | 315/137 |
| 3,836,816 | 9/1974 | Heck | 315/101 X |
| 4,172,981 | 10/1979 | Smith | 307/66 |
| 4,288,725 | 9/1981 | Morton | 315/245 |
| 4,500,812 | 2/1985 | Roche | 315/205 |
| 4,518,897 | 5/1985 | Proud et al. | 315/260 |
| 4,751,435 | 6/1988 | Roche et al. | 315/260 X |
| 4,754,194 | 6/1988 | Fieliciano et al. | 313/632 X |

OTHER PUBLICATIONS

Capacitor Ballast for a Compact Fluorescent Lamp-Yoshio Watanabe-J. Light & Vis. Env. vol. 7 No. 1 1983 (pp. 7-14).

Single-Ended Compact Fluoroescent Lamp with Multi-Arc Caused by Anode Oscillations-Watanabe et al.-Journal of IES/Jul. 1982 (pp. 216-222).

*Primary Examiner*—Eugene R. LaRoche
*Assistant Examiner*—Do Yoo
*Attorney, Agent, or Firm*—Carlo S. Bessone

[57] ABSTRACT

An AC operated glow lamp having a cathode electrode and a pair of anode electrodes driven from a capacitively ballasted autotransformer that provides phase inversion so as to enable a full wave rectification of the discharge current thus operating in a DC regime from an AC line. The double anode lamp and ballast circuitry provides for rapid lamp starting as well as continuous cathode heating during lamp operation.

11 Claims, 2 Drawing Sheets

GLOW DISCHARGE LAMP HAVING DUAL ANODES AND CIRCUIT FOR OPERATING SAME

FIELD OF THE INVENTION

The present invention relates in general to ballast circuits for lamps, and pertains, more particularly, to electronic ballast circuits, particularly for use with electric discharge lamps (e.g., glow discharge lamps having two anodes).

BACKGROUND OF THE INVENTION

An electric discharge lamp, such as a glow lamp, is essentially a low voltage (10–15 volt) discharge device. A significant discharge current has to be provided by a corresponding ballast device in order to obtain a reasonable lamp wattage, such as a wattage in the range of at least 20–30 watts. One such ballast device is an inductive ballast that typically drops about 80% of the line voltage across the ballast element. There are many applications in which such an inductive ballast are effective. However, for, in particular, low voltage, high current electric discharge lamps, such as negative glow lamps, an inductive ballast is highly inefficient. For example, in the particular case of a 15 volt high current negative glow lamp, undesirably, substantially all of the RMS line voltage would be dropped across the ballast element.

Accordingly, the use of an inductive ballast for this type of lamp, in other words for a low voltage high current discharge lamp, results in poor system efficiency. Because of the relatively high currents required by these lamps, the corresponding Joule heating loss ($I^2R$, eddy current, hysteresis, etc.) is much higher for a lamp operating at lower currents. In this regard, the higher current referred to would be in the range of 2–5 amps and the lower currents would be less than one amp. Accordingly, it is desirable because of these poor efficiencies associated with inductive ballasts to instead provide a more efficient ballast circuit, particularly for use with discharge lamps including DC glow discharge lamps.

Modifications to inductive ballasts have also been carried out. For example, inductive ballasts can be designed so that resistive and magnetic power losses are minimized. However, to minimize both the ballast weight and system power losses, a capacitive ballast is preferred.

Prior U.S. patents that describe the use of capacitive ballasts with or without rectifier circuits include U.S. Pat. No. 2,356,369 to Abernathy; U.S. Pat. No. 4,288,725 to Morton; U.S. Pat. No. 4,172,981 to Smith; U.S. Pat. No. 4,500,812 to Roche; and U.S. Pat. No. 3,787,751 to Farrow.

A capacitive ballast has also been employed with a bridge rectifier for use with arc discharge lamps. In this regard, refer to, for example, the article "Capacitor Ballast for a Compact Fluorescent Lamp" by Watanabe, J. Light & Vis. Env., Vol. 7, No. 1, 1983, pages 7–14. In this article, refer in particular to the circuit of FIG. 17 employing the combination of a bridge rectifier and capacitor ballast.

The article "Single-Ended Compact Fluorescent Lamp With Multi-Arc Caused By Anode Oscillations" by Watanabe et al, Journal of IES, July 1982, pages 216–222 describes a lamp having an inner and outer tube. A plurality of anodes are arranged symmetrically in the space between the outer and inner tubes. As illustrated by FIG. 1 therein, the operating circuit consists of a choke ballast, a full wave rectifier to convert AC to DC, and a starter. The resulting configuration produces four discharges occurring simultaneously in time and located in separate discharge spaces within the lamp envelope.

Reference is also made herein to FIG. 1 for an illustration of the use of a capacitor ballast in conjunction with a full-wave rectifier bridge for operating a low voltage, high current DC discharge lamp. More particularly, FIG. 1 illustrates the ballast element as capacitor C. The full wave rectifier bridge is comprised of diodes D1–D4 interconnected in the normal bridge rectifier configuration. The input AC signal which typically is a 120 volt AC signal is coupled at the terminals 10. The terminals 10 connect in series with the capacitor C to the input of the full-wave rectifier bridge. The output of the full-wave rectifier bridge may be considered as coupling to the glow discharge lamp 12.

The glow discharge lamp 12 is comprised of an anode 14 and a cathode 16. Also illustrated in FIG. 1 is the switch 20. The switch 20 couples, in one position thereof, across the cathode 16. The operation of the switch 20 is well known and is operable for lamp starting. Refer, for example, to similar starting switch configurations found in U.S. Pat. No. 2,356,369 or U.S. Pat. No. 4,288,725 previously referred to.

One of the drawbacks associated with the electronic ballast circuit of FIG. 1 is the characteristic of the circuit of operating with a single hot spot operation regime for the lamp cathode. This is illustrated by the arrows 18 in FIG. 1. In essence, the discharge current flows to the same point on the cathode, as illustrated by arrows 18, during each half cycle of the AC signal.

Another drawback associated with the electronic ballast circuit of FIG. 1 has to do with cost and associated power consumption considerations. For a typical glow lamp with a two amp discharge current and a line voltage of 120 volts there is a requirement for a relatively large capacitor on the order of 50 microfarads. Furthermore, the diode losses are the considerable part of the total power which is on the order of 3–5 watts. In addition, the cost of four high current, high voltage diodes is not insignificant.

Still a further disadvantage of the electronic ballast circuit of FIG. 1 is the absence of a filament preheat during lamp operation as well as need of reswitching the lamp from starting to operation regime.

U.S. Pat. No. 4,518,897, which issued to Proud et al. On May 21, 1985, relates to a lamp having a cathode electrode and a pair of anodes. Each of the anodes are connected to respective ends of the cathode electrode.

SUMMARY OF THE INVENTION

Accordingly, it is an object of the present invention to provide an improved electronic ballast circuit, particularly an electronic ballast circuit for use in powering low voltage, high current discharge lamps.

Another object of the present invention is to provide an improved glow lamp with a ballasting self-starting device that provides for rapid lamp starting.

A further object of the present invention is to provide an improved electronic ballast circuit for a discharge lamp in which there is provided continuous cathode heating of the lamp during lamp operation.

Still another object of the present invention is to provide an improved ballast circuit for a discharge lamp in which there is provided full cycle rectification of the discharge current.

Still a further object of present invention is to provide an improved electronic ballast circuit as in accordance with the preceding object and in which the rectification is provided without requiring separate diodes or bridge rectification.

A further object of the present invention is to provide a glow discharge lamp wherein the entire discharge occurs in the same discharge space and alternates between the two anodes every half-cycle of the supply.

These and other objects, advantages and capabilities are achieved in accordance with one aspect of the invention by providing, in combination, an electric discharge lamp having one and other anode electrodes and a cathode electrode and electronic ballast circuitry. There are one and other input terminals for receiving an input AC signal that has one and other half-cycles. The one and other input terminals are coupled to respective one and other anode electrodes. This coupling includes a ballast element connected from one of the input terminals. Phase inverting means intercouple the cathode electrode with the anode electrodes to enable discharge current flow between the cathode electrode and the one anode electrode during one half-cycle of the AC signal, and to enable discharge current flow between the cathode electrode and the other anode electrode during the other half cycle of the AC signal.

In connection with more particular aspects of the present invention the ballast element preferably comprises a capacitive element. Furthermore, the phase-inverting means preferably comprises a transformer means. The transformer means is preferably in the form of an autotransformer having a series winding with ends thereof coupled between the respective one and other anode electrodes. To complete the connection between the circuit and the lamp there is also provided a connection between the cathode electrode and an intermediate position of the autotransformer series winding. In this regard there are preferably two taps from the series winding connected to respective ends of the cathode.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
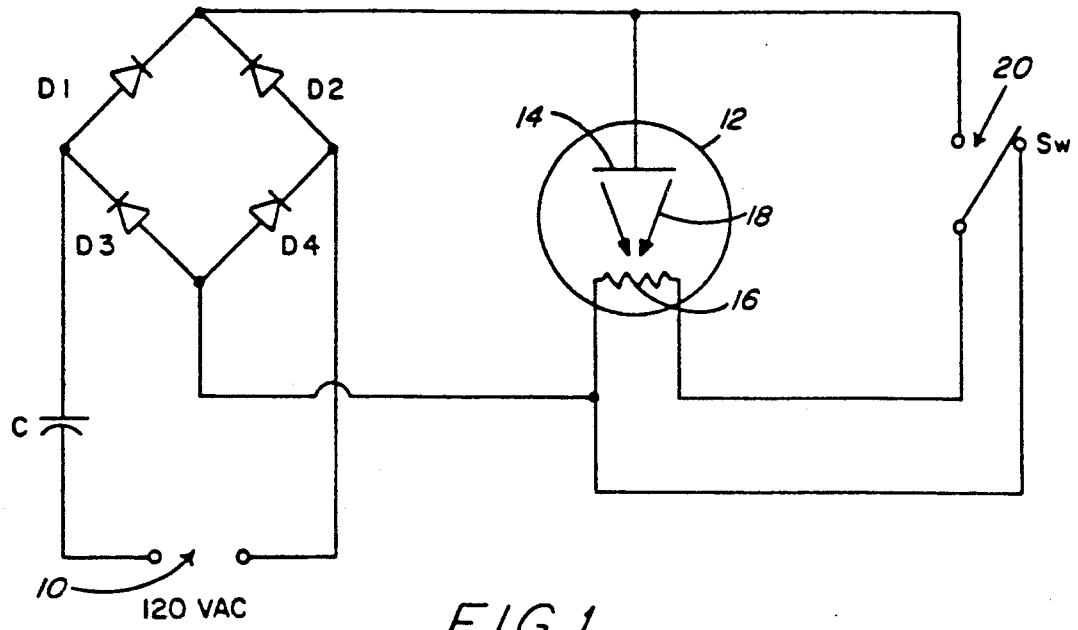
FIG. 1 PRIOR ART
FIG. 1 is a prior art electronic ballast circuit employing a capacitor ballast element and bridge circuit.

The present invention relates to an electronic ballast circuit in combination with a special configuration of discharge lamp. More particularly, in a preferred embodiment herein the circuit is of a capacitive ballast type for use with a discharge lamp such as a DC glow lamp. In accordance with the present invention the glow lamp itself functions as a rectifier, thus eliminating the need for rectifier diodes or some type of diode bridge construction such as illustrated in FIG. 1 herein.

In accordance with the present invention the glow lamp that is employed uses two anode electrodes in combination with a phase-inverting means so that the single cathode electrode of the lamp operates during both of the AC half-cycles. This phase inverting means, in the preferred embodiment disclosed herein, is in the form of an autotransformer.

Figure 2:
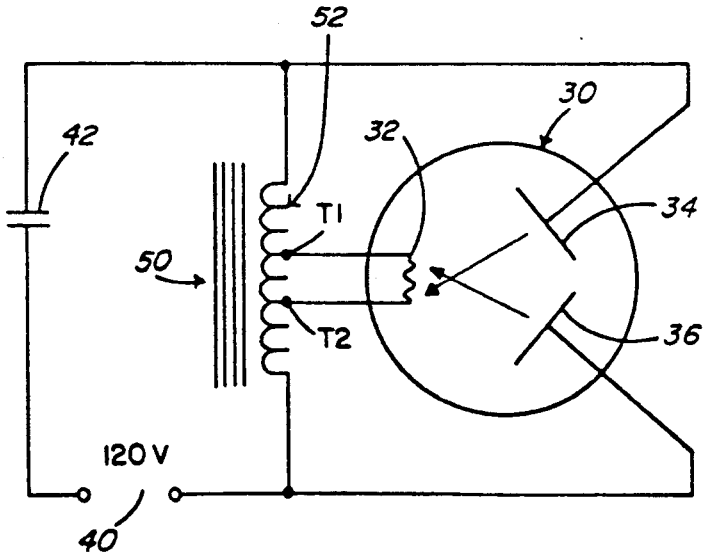
FIG. 2 is a circuit diagram of the preferred embodiment of the electric discharge lamp of the present invention with associated ballasting, self-starting circuitry.

Now with specific reference to FIG. 2 there is illustrated the glow lamp 30 having a single cathode electrode 32 and a pair of anode electrodes 34 and 36. The AC input signal is connected at the input terminals 40. A ballast capacitor 42 is connected from one of the input terminals as illustrated. The other side of the capacitor 42, as well as the other input terminal couples to an autotransformer 50 having a series winding 52. The winding 52 in essence connects between the anode electrodes 34 and 36, respectively. The winding 52 has a pair of spaced taps T1 and T2. Leads couple from the taps T1 and T2 to the cathode electrode 32.

In the circuit of FIG. 2, as indicated previously, there is employed a two anode lamp with the phase inverting being provided primarily by means of the autotransformer 50. The capacitor 42 performs the function of the ballast. By means of the use of a step-down autotransformer 50 as illustrated, the capacity and size of the capacitor 42 can be reduced in half. For example, only a current of one amp is needed to flow through the winding 52 to provide a two amp discharge current through the lamp. Furthermore, the use of an autotransformer has the additional advantage of higher efficiency and less weight than a regular transformer for transforming the same level of electrical power.

In the preferred circuit of FIG. 2, the autotransformer 50 provides heating of the cathode electrode 32 and furthermore implements a circuit that feeds the two anode electrodes 34 and 36 with equal amplitude voltages having opposite phases for each anode electrode.

During one given half-cycle of the AC signal, when anode electrode 34 is positive with respect to cathode electrode 32, electrons flow from one of the input terminals 40 through capacitor 42, anode electrode 34 via its associated lead-in wire, cathode electrode 32 and one of its lead-in wires to T2, the lower portion of winding 52 on autotransformer 50 to the other one of the input terminals 40. During this same half-cycle, the negative anode 36 repels electrons without emission. On the other half-cycle of the AC signal, when anode 36 is positive with respect to cathode electrode 32, electrons flow from one of the input terminals 40 through anode electrode 36 via its associated lead-in wires, cathode electrode 32 and the other of its lead-in wire to T1, the upper portion of winding 52, through capacitor 42 to the other input terminal 40. During this half-cycle, the negative anode 34 repels electrons without emission. Cathode electrode 32 is continuously heated with AC current provided by the portion of winding 52 between taps T1 and T2.

In the circuit of FIG. 2, the voltage across the entire winding 52 is about twice that of the discharge voltage (10–15 volts). Consequently, the current through the winding 52 is approximately half the discharge current. Thus, for ballasting this autotransformer 50, a smaller capacitor can be used. For example, a capacitor of only 25 microfarads may be employed for an AC voltage of 120 volts with a two amp glow lamp.

Another advantage of the arrangement of FIG. 2, is that the cathode of the discharge lamp works in a two hot-spot regime. This is desirable for good cathode maintenance. This comes about by virtue of the fact that during each half-cycle the discharge from the anode electrode will be to a different spot on the cathode electrode as it is shown in FIG. 2 by arrows. This thus provides the so-called "two spot" regime operation.

Another important advantage of the present invention is its inherent rapid start feature. Rapid starting is provided without any additional switches, such as bimetal or glow-bottle switches. In this regard, unlike the circuit of FIG. 1 described herein, it is noted in FIG. 2 that no such switching is necessary.

When the device of FIG. 2 is initially plugged in thus connecting line voltage at the terminals 40, the device provides higher than twice the discharge voltage on its winding 52. This is because the autotransformer 50 is not loaded by the discharge current. The entire AC voltage on the winding is higher than that in the operation regime. This over-voltage condition provides fast filament heating. As soon as the cathode temperature gets high enough to produce appreciable electron emission, breakdown takes place and the autotransformer 50 becomes normally loaded by the cathode electrode 32 along with the discharge power. The device thus soon transitions from the starting to the operational mode.

Figure 3:
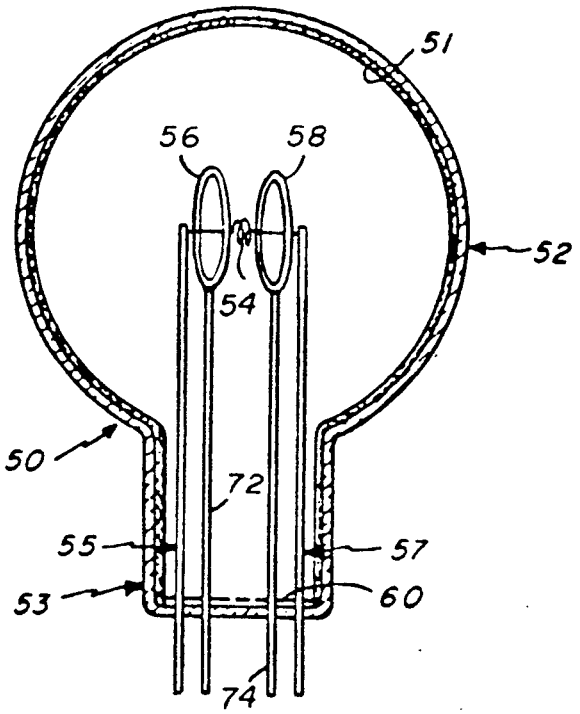
FIG. 3 is a side elevation, cross-sectional view of a glow discharge lamp constructed in accordance with the principles of the present invention.

With particular attention to FIG. 3, there is illustrated a glow discharge lamp for use on the circuit in FIG. 2. Glow discharge lamp 50 includes a lamp envelope that has a bulbous region 52 and a neck region 53. The envelope contains mercury and a noble gas (e.g., neon) at a low pressure, such as 2 torr. A phosphor coating 51 is disposed on an inner surface of the envelope to emit visible light upon absorption of ultraviolet radiation that occurs when the lamp is excited.

Within the envelope there are provided a single cathode electrode 54 and a pair of anode electrodes 56 and 58. Cathode electrode 54 is in the form of an exciter coil having an emissive material disposed thereon. Lead-in wires 55 and 57 support the electrode 54 and electrically couple electrode 54 to taps T1 and T2 (FIG. 2). Preferably, each of the anode electrodes 56, 58 is in the form of a wire ring and disposed so as to completely surround in a coaxial manner a respective portion of cathode electrode 54. Ring anodes 56, 58 lie in parallel planes which are perpendicular to cathode electrode 54. As illustrated in FIG. 3, ring anodes 56, 58 are electrically isolated from cathode electrode 54 as well as from each other. Lead-in wires 72, 74 respectively couple ring electrodes 56, 58 and extend through wafer stem 60. Ring electrodes 56, 58 may each have a diameter of about 1 inch and may be separated a distance of about 1 centimeter from each other.

There has thus been shown and described a glow discharge lamp and operating circuit. The unique circuit operates a glow discharge lamp having two anodes in a DC regime from an AC line signal. Unlike the prior art, the present invention provides a discharge which alternates between each anode every half-cycle of the line signal without additional diodes and switches. Moreover, the discharge occurs in the same discharge space which eliminates the need for an inner tube or channel within the lamp. The circuit provides rapid lamp starting and continuous cathode heating.

While there has been shown and described what is at present considered the preferred embodiment of the invention, it will be obvious to those skilled in the art that various changes and modifications may be made therein without departing from the invention as defined by the appended claims.

What is claimed is:

1. In combination, an electric discharge lamp having one and other anode electrodes and a cathode electrode common to both said anode electrodes, one and other input terminals for receiving an input AC signal having one and other signal half-cycles, means coupling said one and other input terminals to respective one and other anode electrodes and including a ballast element coupling from one of said input terminals, and phase inverting means comprising an autotransformer intercoupling said cathode electrode with said anode electrodes to enable discharge current flow between said cathode electrode and said one anode electrode during one half-cycle of the AC signal, and to enable discharge current flow between said cathode electrode and said other anode electrode during the other half-cycle of the AC signal.

2. The combination as set forth in claim 1 wherein said ballast element comprises a capacitor.

3. The combination as set forth in claim 1 wherein said phase inverting means comprises transformer means.

4. The combination as set forth in claim 1 wherein said autotransformer includes a series winding means with ends coupled between the respective one and other anode electrodes.

5. The combination as set forth in claim 4 including means connecting the cathode electrode to an intermediate tap means of the autotransformer series winding means.

6. The combination as set forth in claim 5 wherein the tap means includes spaced taps on the winding means connecting to respective ends of the cathode electrode.

7. The combination as set forth in claim 1 wherein said electric discharge lamp is a negative glow discharge lamp.

8. A glow discharge lamp comprising:

a light transmitting envelope containing a noble gas fill and mercury;

a phosphor coating disposed on the inner surface of said envelope;

a cathode electrode disposed in said envelope and having lead-in wires coupled thereto and extending through said envelope; and a pair of anode electrodes disposed in said envelope adjacent said cathode electrode and electrically isolated from said cathode electrode, each of said anode electrodes being in the form of a ring completely surrounding respective portions of said cathode electrode and having lead-in wires coupled thereto and extending through said envelope.

9. The glow discharge lamp as set forth in claim 8 wherein each of said anode electrodes is in the form of a wire.

10. The glow discharge lamp as set forth in claim 9 wherein said anode electrodes lie in parallel planes perpendicular to said cathode electrode.

11. The glow discharge lamp as set forth in claim 10 wherein said anode electrodes have a diameter of about 1 inch and are separated a distance of about 1 centimeter from each other.

* * * * *